US008114827B2

(12) United States Patent
Shamayeli et al.

(10) Patent No.: US 8,114,827 B2
(45) Date of Patent: Feb. 14, 2012

(54) PASTE-LIKE DETERGENT FORMULATION COMPRISING BRANCHED ALKOXYLATED FATTY ALCOHOLS AS NON-IONIC SURFACTANTS

(75) Inventors: Khalil Shamayeli, Düsseldorf (DE); Thomas Merz, Hilden (DE)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 12/671,889

(22) PCT Filed: Aug. 28, 2007

(86) PCT No.: PCT/EP2007/058941

§ 371 (c)(1),
(2), (4) Date: Dec. 7, 2010

(87) PCT Pub. No.: WO2009/026956

PCT Pub. Date: Mar. 5, 2009

(65) Prior Publication Data

US 2011/0094044 A1 Apr. 28, 2011

(51) Int. Cl.

| | |
|---|---|
| ***C11D 1/72*** | (2006.01) |
| ***C11D 1/722*** | (2006.01) |
| ***C11D 3/37*** | (2006.01) |
| ***C11D 7/06*** | (2006.01) |
| ***B08B 3/04*** | (2006.01) |

(52) U.S. Cl. ..... 510/356; 510/339; 510/340; 510/360; 510/417; 510/421; 510/435; 510/475; 8/137

(58) Field of Classification Search ..... 510/339, 510/340, 356, 360, 417, 421, 435, 475; 8/137
See application file for complete search history.

(56) References Cited

U.S. PATENT DOCUMENTS

2007/0123447 A1 5/2007 Killeen et al.

FOREIGN PATENT DOCUMENTS

| | | |
|---|---|---|
| DE | 3928601 | 3/1991 |
| DE | 19548843 | 7/1997 |
| WO | WO2004/099355 | 11/2004 |
| WO | WO 2007/101470 | * 9/2007 |

* cited by examiner

*Primary Examiner* — Brian P Mruk

(57) ABSTRACT

The invention relates to a hydrous, paste-like cleaning or detergent composition comprising an emulsion having an aqueous phase and an oil phase, the composition comprises based on the whole concentrate 1 to 50 wt-% of one or more alkalinity source, 1 to 60 wt-% of a guerbet alcohol ethoxylate of the formula $R_1$—$(OC_2H_4)_n$—OH, wherein $R_1$ is a branched $C_9$ to $C_{20}$ alkyl group and n is from 2 to 10, 1 to 30 wt-% of a linear alkoxylated fatty alcohol of the formula $R_2$—$(OC_2H_4)_x$—$(OC_3H_6)_y$—OH, wherein $R_2$ is a linear $C_{10}$ to $C_{16}$ group and n is from 3 to 7 and m is from 3 to 7, 0.01-10 wt-% of one or more crosslinked or partly crosslinked polyacrylic acid or polymethacrylic acid or mixtures thereof, 1-10 wt-% of a thickener system comprising the following components: 1-5 wt-% of a polyacrylate, 0-5 wt-% of a swellable phyllosilicate, 0-2 wt-% of a polyethylene glycol with the provision that the thickener system comprises at least two of these components, and the rest up to 100 wt-% is water.

21 Claims, No Drawings

PASTE-LIKE DETERGENT FORMULATION COMPRISING BRANCHED ALKOXYLATED FATTY ALCOHOLS AS NON-IONIC SURFACTANTS

The invention relates to a storable hydrous, paste-like cleaning or detergent composition and to a method for washing textiles. The cleaning or detergent composition is an emulsion of the water-in-oil-type emulsion or oil-in-water emulsion, dependent on the amounts of water and oil in the emulsion.

BACKGROUND OF THE INVENTION

In institutional and industrial washing processes the wastewater of the washing process is usually cleaned and purified by using membrane filtration units. The obtained purified water can then be re-used in another washing cycle. The use of a membrane filtration process for the cleaning of wastewater results in a decrease of the amount of fresh water required to be added to the washing cycle and accordingly in a reduction of costs and saving resources. Also from an environmental point of view the use of membrane filtration is advisable.

However, the membrane cleaning processes can only be applied for wastewater which does not contain components blocking the membrane of the membrane filtration unit. Therefore it is necessary to use membrane-compatible detergents in these washing processes which do not contain any membrane-blocking or membrane-destroying components.

In the state of the art membrane-compatible detergent compositions are already known. However, most of these detergents are detergents in paste form having a high viscosity that changes significantly with temperature and strongly increases at low temperatures.

WO 02/46351 A1 describes for example a membrane-compatible paste-like composition which is used in a washing process in which the wastewater is purified by a membrane filtration unit and especially in a membrane filtration unit comprising one or more reverse osmosis steps. The detergent comprises non-ionic surfactants, an alkalinity source, and water.

As non-ionic surfactants linear fatty alcohol alkoxylates are used which are ethoxylated. Furthermore the composition comprises alkyl polyglycoside having 8 to 14 carbon atoms.

The paste has a high viscosity being between 50,000 to 250,000 mPas at 5 and/or 50 revolutions per minute measured using a Brookfield rotational viscosimeter with spindle no. 7 at 25° C.

A further pasty soap detergent is described in WO 2005/118760 A1. This detergent is also used in a washing process in which the accumulated wastewater is cleaned by a filtration process using a membrane filtration unit. The detergent comprises anionic surfactants, non-ionic surfactants, an alkalinity source, and an organic and/or inorganic builder on a non-silicate basis. Furthermore the composition is free of greying inhibitors on a cellulose basis, silicates, and phosphates.

As non-ionic surfactants linear fatty alcohol alkoxylates are used which are ethoxylated. Furthermore the composition comprises alkyl polyglycoside having 8 to 14 carbon atoms.

The paste has a an even higher viscosity being between 50,000 to 300,000 mPas at 5 and/or 50 revolutions per minute measured using a Brookfield rotational viscosimeter with spindle no. 7 at 25° C.

Liquid detergents are also known from the state of the art. Such detergents are, for example, described in U.S. Pat. No. 5,880,083, WO 2004/065535 A1, and WO 2004/041990 A1. However, the liquid detergents being used in the state of the art often contain components causing the blocking of the membrane filtration unit and hence cannot be used for washing processes in which membrane filtration units are used for the cleaning of the wastewater. Those components, if used in high amounts, are for instance cationic surfactants, certain emulsifiers, carboxymethylcellulose and silicates. These components immediately block the membrane and lead to an interruption of the whole washing process. By leaving out such components the stability of the liquid detergent composition which normally is an emulsion or dispersion decreases. This decreased stability results in a separation of the emulsion or the dispersion after storage or when used at extremely different temperatures. Separated emulsions or dispersions cannot be used in the washing process and cannot be dosed applying the usual dosing units.

SUMMARY OF THE INVENTION

The technical object of the invention is to provide a paste-like membrane-compatible cleaning or detergent composition having a low viscosity to allow for the composition being pumped through the washing device by using standard pumping units. Furthermore the viscosity should not change significantly with temperature. Nevertheless, the compositions must be stable emulsions which do not separate in several phases after being stored or when used at extremely different temperatures.

The technical object of the invention is solved by a hydrous, paste-like cleaning or detergent composition comprising an emulsion having an aqueous phase and an oil phase and the composition comprises, based on the whole concentrate, 1 to 50 wt-%, preferably 5 to 40 wt-% and most preferred 10 to 30 wt-% of one or more alkalinity source, 1 to 60 wt-%, preferably 5 to 50 wt-%, more preferred 7 to 40 wt-% and most preferred 10 to 30 wt-% of a guerbet alcohol ethoxylate of the formula $R_1—(OC_2H_4)_n—OH$, wherein $R_1$ is a branched $C_9$ to $C_{20}$ alkyl group, preferably a branched C10 to C18 alkyl group and n is from 2 to 10, preferably 5 to 9, 1 to 30 wt-%, preferably 5 to 35 wt-%, more preferred 7 to 25 wt-%, and most preferred 9 to 15 wt-% of a linear ethoxylated/propoxylated fatty alcohol of the formula $R_2—(OC_2H_4)_x—(OC_3H_6)_y—OH$, wherein $R_2$ is a linear $C_{10}$ to $C_{16}$ group and x is from 3 to 7 and y is from 3 to 7, 0.01-10 wt-%, preferably 0.1 to 5 wt-%, more preferred 0.2 to 2 wt-% and most preferred 0.3 to 0.9 wt-% of one or more cross linked or partly cross linked polyacrylic acid or polymethacrylic acid or mixtures thereof, 1-10 wt-%, preferably 1-6 wt-% of a thickener system comprising 1-5 wt-%, preferably 1-3 wt-% of a polyacrylate, preferably polyacrylate dissolved in a hydrocarbon, 0-5 wt-%, preferably 0-3 wt-% of a swellable phyllosilicate, preferably Bentonit, and 0-2 wt-%, preferably 0-1 wt-% of a polyethylene glycol, preferably polyethylene glycol with a molecular weight of 6000 g/mol, provided that the thickener system comprises at least two of these components, and the rest up to 100 wt-% is water.

DETAILED DESCRIPTION OF THE INVENTION

Surprisingly it was found that a thickener system comprising at least two components selected from the group consisting of a polyacrylate, a swellable phyllosilicate and a polyethylene glycol applied to a cleaning or detergent compositional-lows for a composition having comparatively low viscosity which does not significantly change with temperature. During experiments it was found that this thickener system was also membrane compatible.

The hydrous, paste-like cleaning or detergent composition according to the invention only contains components which do not affect the filtration process in the membrane filtration unit and do not block the membrane. Furthermore the composition according to the invention is a stable emulsion which does not separate when being stored. The emulsion is stable at lower temperatures, for example 5° C., but is also stable at higher temperatures, for example 50° C. This is particularly important when the emulsion is stored outside, for example in the summer-time, when outside temperatures are above 35° C. Even under these extreme conditions the composition according to the invention is a stable emulsion, does not separate and recovers completely at ambient temperatures.

Usually the detergent composition is available as a paste and/or shipped or stored as a paste.

The paste-like composition is ready to use. However, the composition may also be diluted at the location of use to provide a use solution. Furthermore it is also possible to first dilute the composition in order to provide a liquid concentrate. A ready-to-use composition may then be prepared by further diluting the liquid concentrate.

The hydrous, paste-like composition comprises one or more alkalinity sources in an amount of 1-50 wt-%, preferably 5 to 40 wt-% and most preferred 10 to 30 wt-%. The alkalinity source can be an alkali hydroxide, preferably sodium hydroxide and/or potassium hydroxide.

The liquid detergent concentrate composition according to the invention further comprises 1 to 60 wt-%, preferably 5 to 50 wt-%, more preferred 10 to 40 wt-% and most preferred 10 to 30 wt-% of a non-ionic surfactant. The non-ionic surfactant is a Guerbet alcohol ethoxylate of the formula $R^1$—$(OC_2H_4)_n$—(OH), wherein $R^1$ is a branched $C_9$-$C_{20}$ alkyl group and n is from 2 to 10.

In a preferred embodiment the guerbet alcohol ethoxylate being used in the liquid detergent concentrate composition is a mixture of two different guerbet alcohol ethoxlyates of the formula $R^1$—$(OC_2H_4)_n$—OH, wherein for the first guerbet alcohol ethoxylate $R^1$ is a branched $C_{10}$ to $C_{18}$ alkyl group and n is from 5 to 10, preferably 7 to 9 and wherein for the second guerbet alcohol $R^1$ is $C_8$ to $C_{12}$ branched alkyl group, preferably branched $C_{10}$ alkyl group and n is 2 to 4, preferably 3. Such guerbet alcohols are available, for example, under the trade name Lutensol from BASF or Eutanol G from Cognis.

The guerbet reaction is a self-condensation of alcohols by which alcohols having branched alkyl chains are produced. The reaction sequence is related to the Aldol condensation and occurs at high temperatures under catalytic conditions. The product is a branched alcohol with twice the molecular weight of the reactant minus a mole of water. The reaction proceeds by a number of sequential reaction steps. At first the alcohol is oxidised to an aldehyde. Then Aldol condensation takes place after proton extraction. Thereafter the aldol product is dehydrated and the hydrogenation of the allylic aldehyde takes place.

These products are called guerbet alcohols and are further reacted to the non-ionic alkoxylated guerbet alcohols by alkoxylation with i.e. ethylene oxide or propylene oxide. The ethoxylated guerbet alcohols have a lower solubility in water compared to the linear ethoxylated alcohols with the same number of carbon atoms. Therefore the exchange of linear fatty alcohols by branched fatty alcohols makes it necessary to use good solubilizers which are able to keep the guerbet alcohol in solution and the resulting emulsion stable even over a longer storage time. This result is surprisingly achieved by the use of one or more crosslinked or partly crosslinked polyacrylic acids and/or polymethacrylic acids in the composition.

The hydrous, paste-like composition according to the invention further comprises 1-30 wt-%, preferably 5-35 wt-%, more preferred 7 to 25 wt-% and most preferred 9-15 wt-% of a linear alkoxylated fatty alcohol of the formula $R^2$—$(OC_2H_4)_x$—$(OC_3H_6)_y$—(OH) in a preferred embodiment the ethoxylated/propoxylated fatty alcohol includes $C_{12}$-$C_{14}$ alcohols containing 5 EO (ethylene oxide) units and 4 PO (propylene oxide) units. These fatty alcohol alkoxylates are, for example, available as Dehypon LS54 from Cognis.

The non-ionic surfactants are used to provide the cleaning or detergent composition with a desired detersive property.

A further component of the cleaning or detergent composition is 0.01 to 10 wt-%, preferably 0.05 to 8 wt-%, most preferred 0.1 to 5 wt-% of one or more crosslinked or partly crosslinked polyacrylic acids and/or polymethacrylic acids. This substance is used as stabiliser for a liquid detergent concentrate composition which is an emulsion. In a preferred embodiment polyacrylic acid or polymethacrylic acid is crosslinked or partly crosslinked with a polyalkenyl polyether compound as crosslinker. Those compounds are available under the trade name Carbopol® from Noveon.

The hydrous, paste-like cleaning or detergent composition according to the invention has a viscosity in the range of from 30,000 to 300,000 mPas, preferably 20,000 to 200,000 mPas, and most preferred from 15,000 to 150,000 mPas at 20° C. measured at 5 and/or 50 revolutions per minute on a Brookfield RVT viscosimeter with spindle no. 7. This low viscosity allows it to pump the composition by using standard pumping devices and it is not necessary to use specific pumping devices for high-viscous liquids.

As mentioned above the hydrous, paste-like cleaning or detergent composition according to the invention is a membrane-compatible composition. That means that it does not contain any components destroying or blocking the membrane which is used for the cleaning of the wastewater in the washing process. Therefore the composition according to the invention does not contain any cationic surfactant. Exemplary cationic surfactants which are not contained in the composition according to the invention include quaternary ammonium compounds, amine salts, and mixtures thereof.

There are other compounds which are normally used in liquid detergents also having a negative effect on the membrane filtration unit if they are present in higher amounts.

In a preferred embodiment the hydrous, paste-like cleaning or detergent composition according to the invention contains alkyl polyglycoside as emulsifying agent in an amount less than 1 wt-%. Preferably no alkyl polyglycoside is present. Alkyl polyglycoside is used as an emulsifier in detergent compositions. However, alkyl polyglycosides tends to foam building in the detergent composition and thus lower the washing performance of the detergent. Furthermore the building of foam has a negative influence on the membrane filtration unit as a liquid with foam on it is difficult to filter in the membrane filtration unit.

The same applies to a further component normally used in other liquid detergents, namely fatty acid soaps. Fatty acid soaps are often used as inorganic surfactants in liquid detergents. However, similar to alkyl polyglycoside, fatty acid soaps tend to accelerate the building of foam especially in soft water. Therefore, in a preferred embodiment the amount of fatty acid soap in the concentrate composition according to the invention is lower than 1 wt-%, preferably no fatty acid soap is present in the liquid detergent concentrate composition according to the invention. Besides sodium or potassium soaps form lime soaps in the presence of hard water. Lime soaps are water insoluble and block membranes.

In a further preferred embodiment the composition according to the invention comprises less than 1 wt-% of complexing agents, selected from the group of nitrilo triacetic acids (NTA) ethylenediamine tetraacetic acid (EDTA) and hydroxyethylenediamine tetraacetic acid (HEDTA). Preferably the composition does not comprise any of these three components. Especially NTA is suspected to be a carcinogenic substance and therefore its use will probably strictly be limited in the future. The amount of ETDA, NTA and HEDTA in the composition is preferably less than 1 wt-%, most preferred less than 0.1 wt-%, more preferred less than 0.01 wt-% and most preferred the compositions is free of ETDA, NTA and HEDTA.

Furthermore the composition comprises less than 2.5 wt-% of phosphor containing compounds, preferably less than 1 wt-%, most preferred less than 0.1 wt-%, more preferred less than 0.01 wt-% and most preferred the composition is free of phosphor containing compounds.

In a preferred embodiment the composition according to claim 1 comprises less than 1 wt-%, preferably less than 0.1 wt-%, more preferred less than 0.01 wt-% and most preferred 0 wt-% of a linear alcohol ethoxylate of the formula $R^3$—$(OC_2H_4)_z$—(OH), wherein $R^3$ is a linear $C_{10}$ to $C_{18}$ alkyl group and z is from 3 to 9. These kinds of linear non-ionic surfactants can be toxic for water organisms.

In a preferred embodiment the composition comprises as complexing agents iminodisuccinate salts and/or methyl glycine diacetic acid salt. Preferably the ratio of the mixture of iminodisuccinate salt to methyl glycine diacetic acid salt is from 6 to 1 to 1 to 1, preferably 2 to 1.

The composition according to the invention has a high stability when stored at room temperature over a longer period of time. The emulsion is even stable below 10° C. and above 45° C. where the emulsion does not separate.

In a preferred embodiment the droplet size of the emulsion before adding the thickener system is less than 25 μm, preferably less than 15 μm.

In a further preferred embodiment the content of water in the composition is between 5 and 35 wt-%, preferably 10 to 25 wt-%.

As the composition is preferably used as a detergent for institutional and industrial washing the detergent does not contain any bleaching agents. In institutional and industrial washing processes the bleaching agent is normally dosed separately from the detergent. Normally bleaching agents are present in powder household detergents.

The paste-like composition according to the invention as well as any use solution of this composition is highly alkaline because it contains high amounts of an alkalinity sources. The pH range of the paste-like composition is 13-14, preferably pH 14. This pH value is by far higher compared to the normal household washing detergents.

The emulsions according to the invention show a viscoelastic behavior. The emulsion is stable at least one year at 5° C. as well as at 20° C. and at 40° C. The emulsion achieves a very high performance level compared to similar liquid detergent concentrates which are not compatible with membrane filtration processes. Furthermore the product fulfils important environmental requirements especially in the European countries because it does not contain in a preferred embodiment EDTA as complexing agent.

The product according to the invention is characterised by a high amount of non-ionic surfactant, a high alkalinity, and a high stability at temperatures below 10° C. and above 45° C. preventing the product from separating. The product is staying stable for a long time and does not separate into different phases nor shows precipitations.

Furthermore the cleaning or detergent composition preferably does not contain carboxymethylcellulose, which is used as greying inhibitor in usual detergents. This compound blocks the membrane of the membrane filtration unit.

The hydrous, paste-like cleaning or detergent composition according to the invention can furthermore contain usual additives selected from the group consisting of builders, pH modifiers, antimicrobial agents, abrasives, anti-redeposition agents, sequestrants, softener, conditioner, viscosity modifying agents, wetting modifying agents, enzymes, optical brightener and mixtures thereof.

Builders and sequestrants that can be used as components include organic builders, inorganic builders, and mixtures thereof. Exemplary organic builders include organic compounds such as the salts or the acid form of nitriloacetic acid and its derivatives, amino carboxylates, organic phosphonates, amides, polycarboxylates, salicylates and their derivatives, derivatives of polyamino compounds or mixtures thereof. Examples of nitriloacetic acid derivatives include sodium nitriloacetate and magnesium nitriloacetate. Exemplary aminocarboxylates include sodium imino-succinates. Exemplary organic phosphonates include amino tri(methylenephosphonate), hydroxyethylidene diphosphonate, diethylenetriamine penta(methylenephosphonate), ethylenediamine tetra(methylenephosphonate), and 2-phosphonobutane-1,2,4-tricarboxylate (Bayhibit AM by Bayer). Exemplary polycarboxylates include citric acid and its salt and derivatives, sodium glutarate, potassium succinate, and polyacrylic acid and its salts and derivatives and copolymers. Exemplary polyamino compounds include diethyltriaminepentaacetic acid (DPTA), hydroxyethylene diamine, and salts and derivatives thereof. Exemplary organic builders include at least one of a builder selected from polyacrylates or their copolymers, iminodisuccinate, citrate, ethylenediamine or triamine derivatives, and mixtures thereof. Exemplary inorganic builders include sodium tripolyphosphate, sodium carbonate, sodium pyrophosphate, potassium pyrophosphate. When the cleaning or detergent composition includes builders and sequestrants the builders and sequestrants can be provided in an amount of between 5 wt-% and 30 wt-%, preferably between 10 wt-% and 20 wt-%, based on the weight of the cleaning or detergent composition.

Exemplary antimicrobials that can be used as the suspended particulate component include alkyl parabens such as methyl paraben and propyl paraben; phenolic derivatives such as t-amylphenol; metals and their oxides and salts such as silver, silver iodide, zinc oxide; halogenated hydantoin derivatives such as bromo-chlorodimethylhydantoin, dichlorodimethylhydantoin, dibromodimethylhydantoin; hypohalites such as calcium hypochlorite, sodium hypobromite; and oligomers or polymers such as povidone iodine or povidone peroxide. When the cleaning or detergent composition includes antimicrobials as the suspended particulate component, the antimicrobials can be provided in an amount of between about 0.001 wt-% and about 3 wt-%, preferably between about 0.5 wt-% and about 2 wt-%, based on the weight of the cleaning or detergent composition.

Exemplary pH modifiers that can be used as the suspended particulate component include inorganic acidic compounds like sodium hydrogen sulfate, calcium hydrogen phosphate, organic acid compounds like carboxylic acids such as oxalic acid, polyacrylic acid, inorganic alkaline compounds like hydroxides, carbonates, and organic alkaline compounds. When the detergent composition includes pH modifiers as the suspended particulate component, the pH modifiers can be provided in an amount of between about 1 wt-% and about 30 wt-%, preferably between about 5 wt-% and about 15 wt-% based on the weight of the cleaning or detergent composition.

Exemplary abrasives suitable for use as the suspended particulate component include calcium carbonate, talc, sodium, pieces of polymeric material such as shredded polyethylene or polypropylene, and pumice. When the cleaning or detergent composition includes abrasives as the suspended particulate component, the abrasives can be provided in an amount of between about 0.5 wt-% and about 10 wt-%, preferably between about 1 wt-% and about 5 wt-%, based on the weight of the cleaning or detergent composition.

Exemplary anti-redeposition agents that can be used as the suspended particulate component include polyacrylates and their copolymers. When the detergent composition includes anti-redeposition agents as the suspended particulate component, the anti-redeposition agents can be provided in an amount of between about 0.1 wt-% and about 10 wt-%, preferably between about 1 wt-% and about 5 wt-%, based on the weight of the cleaning or detergent composition.

Exemplary softeners or conditioners that can be used as the suspended particulate component include both fabric and skin softeners. Exemplary softeners include fatty alcohols, fatty esters, fatty alcohols, glycerine, vitamins, and amino acids. When the detergent composition includes softeners or conditioners as the suspended particulate component, the softeners or conditioners can be provided in an amount of between about 1 wt-% and about 30 wt-%, preferably between about 5 wt-% and about 20 wt-%, based on the weight of the cleaning or detergent composition.

Exemplary viscosity modifiers that can be used as the suspended particulate component include alkanolamides, alkanolamines, and inorganic bases and acids. When the cleaning or detergent composition includes viscosity modifiers as the suspended particulate component, the viscosity modifiers can be provided in an amount of between about 0.1 wt-% and about 5 wt-%, preferably between about 0.5 wt-% and about 2 wt-%, based on the weight of the detergent composition.

Exemplary wetting modification agents that can be used as the suspended particulate component include EO-PO derivatives and silane derivatives. When the cleaning or detergent composition includes wetting modification agents as the suspended particulate component, the wetting modification agents can be provided in an amount of between about 0.1 wt-% and about 5 wt-%, preferably between 0.5 wt-% and about 3 wt-%, based on the weight of the detergent composition.

Exemplary enzymes that can be used as the suspended particulate component include proteases, lipases, amylases, cellulases, oxydases, peroxydases, esterases, and mixtures thereof. The cleaning or detergent composition can include an enzyme in an amount of between 0.1 wt-% and 2 wt-%, preferably between 0.5 wt-% and 1 wt-%.

The cleaning or detergent composition according to the invention optionally contains an anionic surfactant in an amount of 0 to 15 wt-%, preferably of from 0.5 to 8 wt-%, which may be selected from the compounds comprising C8-C18 alkyl sulfates, C8-C18 alkyl ether sulfates, C8-C18 alkyl sulfonates, C8-C18-olefine sulfonates, sulfonated C8-C18 fatty acids, C8-C18 alkyl benzene sulfonates, sulfosuccinate mono and di C1-C12 alkyl esters, C8-C18 alkyl polyglycol ether carboxylates, C8-C18 n-acyl taurides, C8-C18 n-sarcosinates, C8-C18 alkyl isothionates, and mixtures thereof.

The cleaning or detergent composition includes a sufficient amount of water which is present in an amount of between 5 and 35 wt-%, preferably between 10 and 25 wt-% related to the cleaning or detergent composition.

In general a stable emulsion is characterised by a lack of phase separation when the emulsion is allowed to stand at room temperature for at least seven days. Emulsions with a better performance will not phase separate when allowed to stand at room temperature for at least fourteen days and preferably at least 30 days. The composition according to the invention has an even higher stability which is one year at 5° C. as well as at 20° C. and at 40° C.

The hydrous, paste-like cleaning or detergent composition can be diluted with water to provide a use solution. The step of diluting can take place by pumping into a water stream, aspirating into a water stream, pouring into water or by combining water with the composition. In a preferred embodiment the use solution comprises the composition according to the invention in a concentration of 0.5 to 25 wt-%, preferably 1 to 10 wt-% based on the use solution.

The hydrous, paste-like cleaning or detergent composition is preferably an emulsion. This composition according to the invention is prepared by mixing the solid and the fluid components of the detergent composition when the solid phase is dispersed in the liquid phase as homogeneous as possible. By thoroughly mixing the components and grinding the resulting mixture an emulsion is prepared having a homogeneous distribution of the water and oil phase in the emulsion. During this process the solid parts of the composition are solved in the solvent.

The hydrous, paste-like cleaning or detergent composition according to the invention is used for washing textiles. The method for washing textiles comprises washing the textiles in an institutional or household washing machine. In a preferred embodiment the wastewater of the washing process is accumulated during the washing process and purified using membrane filtration unit.

The hydrous, paste-like cleaning or detergent composition according to the invention has the advantage that the composition allows purification of wastewater which is accumulated during the cleaning or washing process using common membrane filtration units without blocking them or causing other damage to the membrane. The membrane filtration may as well comprise at least one ultrafiltration and/or reverse osmosis step. Said purification processes succeed best with the composition according to the invention.

In addition the hydrous, paste-like cleaning or detergent composition according to the invention is a highly stable emulsion which does not separate when stored for at least one year at 20° C. Furthermore the emulsion is even stable at temperatures below 10° C. and above 45° C.

The inventive composition and the method according to the invention will be further described in the following examples which are meant to exemplify the present invention without restricting its scope. In the following all amounts mentioned refer to wt-% based on the whole composition unless otherwise indicated.

EXAMPLES

Example 1

Composition of the Cleaning or Detergent Composition

Table 1 describes specific examples of the hydrous, paste-like cleaning or detergent composition according to the invention. Examples F-1 to F-10 describe emulsions which are stable over a period of at least 1 year at 5° C. as well as at 20°

C. and at 40° C. Table 1 also describes as comparative examples compositions two compositions CE-1 and CE-2.

TABLE 1

| Components in wt-% | F-1 | F-2 | F-3 | F-4 | F-5 |
|---|---|---|---|---|---|
| hydroxyethylidene diphosphonate acid (3) | 2 | 2 | 2 | 2 | 2 |
| phosphonate/polyacrylate blend (14) | 0 | 0 | 0 | 0 | 0 |
| KOH 50 wt-% | 0 | 0 | 25 | 10 | 10 |
| NaOH 50 wt-% | 25 | 25 | 0 | 6.8 | 25 |
| water glass 37/40 | 14.8 | 8.5 | 8.5 | 10 | 0 |
| iminodisuccinate sodium salt | 10 | 10 | 10 | 7.25 | 10 |
| methyl glycine diacetic acid sodium salt | 5 | 5 | 5 | 6.25 | 5 |
| fatty alcohol C12-14 + 5EO + 4 PO (5) | 9 | 9.5 | 9.5 | 9.5 | 9.5 |
| guerbet alcohol C10-18 + 7EO (8) | 0 | 0 | 0 | 0 | 0 |
| guerbet alcohol C10-18 + 9EO (7) | 0 | 0 | 0 | 9.5 | 5 |
| fatty alcohol C13-15 + 7EO (6) | 9 | 5 | 5 | 0 | 0 |
| guerbet alcohol C10 + 3 EO (9) | 0 | 5 | 5 | 0 | 5 |
| polycarboxylate (4) | 0 | 0 | 0 | 0 | 0 |
| soda | 0 | 9 | 9 | 5 | 9 |
| metasilicate (15) | 7 | 0 | 0 | 0 | 0 |
| acrylic acid/maleic acid blend (16) | 5 | 5 | 5 | 3.5 | 5 |
| polyethylene polyacrylate copolymer | 0 | 0 | 0 | 0 | 0 |
| paraffin (defoamer) | 0.2 | 0 | 0 | 0 | 0 |
| optical brightener (1) | 1 | 0.8 | 0.8 | 0.4 | 1 |
| distyryl biphenyl derivate (2) | 0 | 0.2 | 0.2 | 0.1 | 0 |
| oleic acid (11) | 0.5 | 0.3 | 0.7 | 0 | 0.2 |
| crosslinked polyacrylic acid polymer (10) | 0.25 | 0.28 | 0.15 | 0.3 | 0.25 |
| polyacrylat (12) | 2.5 | 2.8 | 1.5 | 3 | 2.5 |
| phyllosilicate | 0.5 | 0.2 | 1.5 | 0 | 0 |
| polyethylene glycol (13) | 0 | 0 | 0 | 1 | 1 |

| Components in wt-% | F-6 | F-7 | F-8 | F-9 | F-10 |
|---|---|---|---|---|---|
| hydroxyethylidene diphosphonate acid (3) | 0 | 2 | 0 | 0 | 2 |
| phosphonate/polyacrylate blend (14) | 2.5 | 0 | 0 | 2.5 | 0 |
| KOH 50 wt-% | 0 | 0 | 10 | 0 | 0 |
| NaOH 50 wt-% | 25 | 25 | 15 | 8.5 | 25 |
| water glass 37/40 | 10 | 10 | 10 | 21.5 | 10 |
| iminodisuccinate sodium salt | 5 | 10 | 0 | 0 | 14.75 |
| methyl glycine diacetic acid sodium salt | 0 | 5 | 0 | 0 | 7.5 |
| fatty alcohol C12-14 + 5EO + 4 PO (5) | 9.5 | 9.5 | 9.5 | 9.5 | 9.5 |
| guerbet alcohol C10-18 + 7EO (8) | 0 | 0 | 5 | 0 | 0 |
| guerbet alcohol C10-18 + 9EO (7) | 9.5 | 5 | 0 | 5 | 9.5 |
| fatty alcohol C13-15 + 7EO (6) | 0 | 0 | 0 | 0 | 0 |
| guerbet alcohol C10 + 3 EO (9) | 0 | 5 | 5 | 5 | 0 |
| polycarboxylate (4) | 0 | 0 | 3.5 | 2.5 | 0 |
| soda | 12.5 | 10 | 5 | 15 | 5 |
| metasilicate (15) | 0 | 0 | 0 | 0 | 0 |
| acrylic acid/maleic acid blend (16) | 2.5 | 0 | 5 | 0 | 5 |
| polyethylene polyacrylate copolymer | 0 | 5 | 3.5 | 2.5 | 0 |
| paraffin (defoamer) | 0 | 0.5 | 0 | 0.5 | 0 |
| optical brightener (1) | 0.8 | 1 | 1 | 0.5 | 1 |
| distyryl biphenyl derivate (2) | 0.2 | 0 | 0 | 0.1 | 0 |
| oleic acid (11) | 0 | 0 | 0.5 | 0.5 | 0 |
| crosslinked polyacrylic acid polymer (10) | 0.3 | 0.2 | 0.28 | 0.15 | 0.25 |
| polyacrylat (12) | 3 | 2 | 2.8 | 1.5 | 2.5 |
| phyllosilicate | 1.5 | 1.5 | 3 | 2 | 1.5 |
| polyethylene glycol (13) | 0 | 1 | 0 | 0 | 0 |

TABLE 1-continued

| Components in wt-% | CE-1 | CE-2* |
|---|---|---|
| hydroxyethylidene diphosphonate acid (3) | 2.0 | 1.2 |
| 2-butyloctan-1-ol | 5 | 3 |
| sodium citrate dihydrate | 2 | |
| NaOH 50 wt-% | 3.6 | |
| phosphoric acid mono- and distearyl ester | | 1 |
| polyethoxylated oleyl-cetyl alcohol | | 6.5 |
| sodium soap of tallow fatty acids | | 0.9 |
| fatty alcohol C12-14 + EO + PO | | 9.5 |
| propylene glycol | 10 | |
| zeolithe | 5 | |
| fatty alcohol C12-14 + 3EO | | 7.2 |
| perfume | 0.2 | |
| Sodium alkyl benzyl sulfonate powder | | 1.5 |
| soda | 16.5 | 44.6 |
| metasilicate (15) | | 17 |
| acrylic acid/maleic acid blend (16) | 4.7 | 5 |
| phosphonic acid compound | | 0.6 |
| carboxymethylcellulose | 1.5 | 1 |
| optical brightener (1) | 0.375 | 0.75 |
| distyryl biphenyl derivate (2) | 0.125 | 0.25 |
| oleic acid (11) | 12 | |

All amounts are given in wt-%. The rest up to 100 wt-% is deionized water.

*water-free (1) Tinopal DMX/X (Ciba)
(2) Tinopal CBS/X (Ciba)
(3) Dequest 2010 (Solutia)
(4) Alcosperse 175 (Alco)
(5) Dehypon LS54 (Cognis)
(6) Lutensol AO 7 (BASF)
(7) Lutensol M9 (BASF)
(8) Lutensol M7 (BASF)
(9) Lutensol XP 30 (BASF)
(10) Carbopol EDT 2691 (Noveon)
(11) Edenor PK 1805 (Cognis)
(12) Iso-AL Powder
(13) PEG 6000 S (Stepan Europe)
(14) Dequest FS 0534 (Solutia)
(15) Silmaco FE (Silmaco V.N.)
(16) Acusol 497 N (Rohm + Haas)

Example 2

Thermal Stability and Viscosity

The composition according to example F-2 in table 1 was compared with comparative examples CE-1 and CE-2. The compositions were tested with respect to their thermal stability. For testing the thermal stability the viscosity of a sample of the respective composition was measured at different temperatures (5° C.-50° C.) with Rheometer CVO 50 (oscillation method, measurement geometry: plate/plate (diameter: 20 mm)). The results are shown in table 2.

TABLE 2

| | Viscosity (Pa*s) | | | | | | | | | |
|---|---|---|---|---|---|---|---|---|---|---|
| temperature | 5° C. | 10° C. | 15° C. | 20° C. | 25° C. | 30° C. | 35° C. | 40° C. | 45° C. | 50° C. |
| CE-2 (tab. 1) | 2670 | 2692 | 2872 | 2820 | 2790 | 2680 | 2660 | 2300 | 2240 | 1810 |
| CE-1 (tab. 1) | 52630 | 31295 | 18890 | 10040 | 5860 | 3910 | 2007 | 2006 | 1305 | 1380 |
| F-2 (tab. 1) | 212 | 196 | 180 | 163 | 129 | 107 | 87 | 80 | 81 | 90 |

The values shown in table 2 indicate that the composition F-2 according to the invention is thermally stable and has a considerably low viscosity which does not change significantly with temperature. In contrast, the composition according to comparative example 1 CE-1 is thermally not stable and hard to dose due to its high viscosity.

Example 3

Primary Washing Performance

The composition according to example F-2 in table 1 was compared with comparative examples CE-1 and CE-2. The compositions were tested with respect to their washing performance using a common 15 minutes washing cycle at 70° C. with artificial soil strips as commercially available like those by WFK. For testing the primary washing performance 1.2 g/l of the composition and 2 ml/l bleaching agent were used. The primary washing performance was tested with soft water (0° dH (deutsche Härte)). The results are shown in table 3.

TABLE 3

| Composition | Fat/Pigment-Soil remission value (%) | Bleaching-Soil remission value (%) | Enzymatic-Soil remission value (%) |
|---|---|---|---|
| CE-2 (tab. 1) | 53 | 88 | 57 |
| CE-1 (tab. 1) | 50 | 66 | 60 |
| F-2 (tab. 1) | 55 | 87 | 57 |

The values shown in table 3 indicate that the composition according to the invention has a similar primary washing performance in soft water as the comparative compositions.

Example 4

Secondary Washing Performance

Measurement Method Secondary Washing Performance

Laundry control sheets are made of cotton fabric with controlled fabric construction according to DIN 53919.

For testing detergents or washing machines the test fabrics (size ca. 80×100 cm) have to be pre-washed three times with reference detergent according to IEC 60456, the wash program is defined in ISO 6330. After pre-washing the starting values for tensile strength, intrinsic viscosity, absolute whiteness, tint deviation, whiteness without UV and inorganic incrustation of the laundry control sheet batch are evaluated. After this procedure the laundry control sheets are ready for use.

For testing the secondary washing performance of detergents or washing machines a minimum of two or three control sheets should be washed repeatedly (e.g. 20 to 50 times) with the detergents or washing machines to be tested. It is important that the wash programme is not changed in any way during these 20 to 50 wash cycles.

After several washing cycles the above mentioned values are evaluated for each control sheet. The results are compared with the starting values.

Tensile Strength Loss (DIN 53857 Part 1 and DIN 53919 Part 2)

After repeated washings the cotton control cloth generally has a lower breaking strength than it did originally due to the combined action of mechanical and chemical factors operating during several laundering cycles. Any decrease in breaking strength expressed as a percentage of the initial breaking strength is determined from the variation in breaking strength measured in the direction of the warp of the control cloth before and after laundering.

Intrinsic Viscosity and Chemical Damage (Damage Factor s) (DIN 53919 Part 2)

The chemical degradation of the cellulose in cotton cloth caused by the action of chemical agents during the laundering operation usually leads to changes in the intrinsic mechanical properties of the fibers and a decrease in the breaking strength of the cloth. This chemical damage which is a function of the chemical aggressiveness of the laundering process is characterized by a reduction in degree of polymerization of the cellulose constituent.

Chemical wear is caused in the first place by the chemical aggressiveness of washing products, mainly oxidizing agents such as hypochlorite and peroxides.

Absolute Whiteness According to GANZ (WG-Value)

Whiteness as measured by this test method is an indication how white the textile appears to an average viewer. The formula of whiteness are those recommended by the CIE. The CIE tristimulus values are measured using a reflectance spectrophotometer or colorimeter and the whiteness calculated from formulae based on the CIE chromaticy co-ordinates. The formula that W uses for calculating the whiteness of specimen is according to GANZ:

$$W=(D*Y)+(P*x)+(Q*y)+C$$

Y is the CIE tristimulus value of the sample, x and y are the chromaticity co-ordinates of the sample. D, P, and Q are parameters that influence the direction of the white appearance of a specimen.

Tint Deviation (FAZ)

The tint deviation describes the tint difference of the specimen to a neutral white (standard white, barium sulphate). The tint deviation may be in the direction of red-violet (expressed by negative values) or blue-green (expressed by positive values).

Whiteness without UV (Y-Value)

The object of this determination is to provide information on the redeposition of colored pigment soils from soiled white loads usually grey on the cloth. Too high redeposition indicates a defect in the laundering. Greying may also be caused by staining from dyes; obviously, this can only occur when colored materials are present in the wash.

Inorganic Incrustation (Ash Content %) (DIN 53919 Part 2)

The object of this method is the determination of the increase in the incineration residue (ash) of the control cloth. Deposits of mineral products on cloth indicate unsatisfactory detergent action. Redeposition may shorten the useful life of the cloth by modifying its qualities (dull appearance, harsh feel, greying or yellowing) or by promoting chemical or mechanical wear.

To determine the amount of total ash a test portion of approximately 3 g of the specimen is taken and weight to the nearest 0.1 mg. The test portion is calcinated in a muffle furnace at 800° C. for 1 hour and cooled down to ambient temperature in a desiccator. After cool down the test portion is reweight and the ash content of the original cloth is calculated as a percentage by mass.

Results

The composition according to example F-2 in table 1 was compared with comparative examples CE-1 and CE-2. The compositions were tested with respect to their washing performance using 25 common 15 minutes washing cycles at 70° C. with artificial soil strips as commercially available like those by WFK. For testing the secondary washing performance 1.2 g/l of the composition was used. The secondary washing performance was tested with soft water (0° dH (deutsche Härte)). The results are shown in table 4.

TABLE 4

| Composition | WG-Value | Y-Value | FAZ | Tensile Strength (daN) |
|---|---|---|---|---|
| Original Value | 28 | 85 | 0.57 | 94 |
| CE-2 (tab. 1) | 214 | 95 | −0.17 | 87 |
| CE-1 (tab. 1) | 212 | 92.5 | 1.1 | 86 |
| F-2 (tab. 1) | 222 | 94 | −0.03 | 87 |

| Composition | Tensile Strength loss (%) | DP-Value | Chemical Damage (%) | Ash (%) |
|---|---|---|---|---|
| Original Value | | 1967 | | 0.5 |
| CE-2 (tab. 1) | 7 | 1960 | 0 | 0.5 |
| CE-1 (tab. 1) | 8 | 1980 | 0 | 0.3 |
| F-2 (tab. 1) | 7 | 1880 | 0 | 0.5 |

The values shown in table 4 indicate that the composition according to the invention has a similar secondary washing performance in soft water as the comparative compositions.

The invention claimed is:

1. A hydrous, cleaning or detergent composition comprising an emulsion having an aqueous phase and an oil phase, the composition comprising based on the whole composition:

a) 1 to 50 wt-% of one or more alkalinity source;

b) 1 to 60 wt-% of a guerbet alcohol ethoxylate of the formula $$R_1—(OC_2H_4)_n—OH,$$

wherein $R_1$ is a branched $C_8$ to $C_{20}$ alkyl group and n is from 2 to 10;

c) 1 to 30 wt-% of a linear alkoxylated fatty alcohol of the formula $$R_2—(OC_2H_4)_x—(OC_3H_6)_y—OH,$$

wherein $R_2$ is a linear $C_{10}$ to $C_{16}$ group and x is from 3 to 7 and y is from 3 to 7;

d) 0.01-10 wt-% of one or more crosslinked or partly crosslinked polyacrylic acid, polymethacrylic acid, and mixtures thereof;

e) 1-10 wt-% of a thickener system comprising at least two of the following components:

1) 1-5 wt-% of a polyacrylate;

2) 0-5 wt-% of a swellable phyllosilicate; and 3) 0-2 wt-% of a polyethylene glycol; and the rest up to 100 wt-% water wherein the composition has a viscosity range of from 15,000 to 150,000 mPas at 20° C. measured at 5 and/or 50 revolutions per minute on a Brookfield RVT viscosimeter with spindle 7.

2. The composition according to claim 1, wherein the composition comprises 1-6 wt-% of a thickener system comprising the following components:

1) 1-3 wt-% of a polyacrylate 2) 0.1-3 wt-% of a swellable phyllosilicate; and 3) 0.1-1 wt-% of a polyethylene glycol.

3. The composition according to claim 1, wherein the polyacrylate is dissolved in a hydrocarbon the phyllosilicate is Bentonit and the polyethylene glycol is a polyethylene glycol with a molecular weight of 6000 g/mol.

4. The composition according to claim 1, wherein the composition comprises less than 1 wt-% of a linear alcohol ethoxylate of the formula $$R_3—(OC_2H_4)_z—OH,$$

wherein $R_3$ is a linear $C_{10}$ to $C_{18}$ alkyl group and z is from 3 to 9.

5. The composition according to claim 1, wherein the alkalinity source is an alkalihydroxide selected from the group consisting of NaOH, KOH and mixtures thereof.

6. The composition according to claim 1, wherein the crosslinker for the crosslinked polyacrylic acid or polymethacrylic acid is a polyalkenyl polyether compound.

7. The composition according to claim 1, wherein the composition does not contain a cationic surfactant.

8. The composition according to claim 1, wherein the amount of alkyl polyglycoside in the detergent is less than 1 wt-%.

9. The composition according to claim 1, wherein the amount of fatty acid soap in the detergent is less than 1 wt-%.

10. The composition according to claim 1, wherein the amount of ethylene diamine tetraacetic acid, nitrilo triacetic acid, and hydroxy ethylene diamine tetraacetic acid in the detergent is less than 1 wt-%.

11. The composition according to claim 1, wherein the composition is membrane compatible.

12. The composition according to claim 1, wherein the composition comprises less than 2.5 wt-% of phosphor containing compounds.

13. The composition according to claim 1, wherein the composition further comprises a complexing agent selecting from the group consisting of iminodisuccinate salt, methyl glycine diacetic acid salt, and mixtures thereof.

14. The composition according to claim 13, wherein the ratio of the iminodisuccinate salt to methyl glycine diacetic acid salt is from 6 to 1 to 1 to 1.

15. The composition according to claim 1, wherein the detergent does not contain any bleaching agent.

16. The composition according to claim 1, wherein the detergent contains 5 to 35 wt-% water.

17. The composition according to claim 1, wherein the detergent additionally comprises additives selected from the group consisting of builder, pH modifier, antimicrobial agents, abrasives, anti-redeposition agents, sequestrants, softener, conditioner, viscosity modifying agents, wetting modifying agents, enzymes, optical brighteners, and mixtures thereof.

18. The composition according to claim 1, wherein the guerbet alcohol ethoxylate is a mixture of two different guerbet alcohol ethoxylates of the formula $$R_1—(OC_2H_4)_n—OH,$$

wherein for the first guerbet alcohol ethoxylate $R_1$ is a branched $C_{10}$ to $C_{18}$ alkyl group and n is from 5 to 10 and for the second guerbet alcohol $R_1$ is $C_8$ to $C_{12}$ and n is 2 to 4.

19. The composition of claim 1, wherein the composition is configured for washing textiles.

20. The composition of claim 19, wherein the composition can be passed through a membrane filter.

21. The composition according to claim 1, wherein the composition is configured for use as a detergent in a washing machine selected from the group consisting of institutional washing machines, and household washing machines.

* * * * *